US005255905A

United States Patent [19]

Reid et al.

[11] Patent Number: 5,255,905

[45] Date of Patent: Oct. 26, 1993

[54] DOWNHILL BOTTOM VACUUM CORRUGATED FEEDER AND METHOD

[75] Inventors: Paula E. Reid, Rochester; Kendolph A. Thomas, Ontario; John R. Falvo, Rochester; Charles D. Rizzolo, Irondequoit; William D. Milillo, Ontario; James F. Smoak, Webster; Michele D. Taber, Rochester, all of N.Y.

[73] Assignee: Xerox Corporation, Stamford, Conn.

[21] Appl. No.: 981,049

[22] Filed: Nov. 24, 1992

[51] Int. Cl.[5] ..... B65H 3/12

[52] U.S. Cl. ..... 271/94; 271/98; 271/99; 271/104; 271/236; 271/165; 271/167; 271/3.1

[58] Field of Search ..... 271/94, 96, 98, 99, 271/104, 105, 30.1, 35, 236, 245, 165, 166, 167, 3.1

[56] References Cited

U.S. PATENT DOCUMENTS

| | | | |
|---|---|---|---|
| 3,612,511 | 10/1971 | Godlewski | 271/35 |
| 4,346,879 | 8/1982 | Ruenzi | 271/167 |
| 4,469,320 | 9/1984 | Wenthe | 271/94 |
| 4,566,683 | 1/1986 | Moore | 271/35 |
| 4,606,535 | 8/1986 | Larson | 271/165 |
| 5,069,436 | 12/1991 | Lubberts | 271/35 |
| 5,071,110 | 12/1991 | Arnone et al. | 271/104 |
| 5,083,766 | 1/1992 | Osawa | 271/165 |
| 5,167,407 | 12/1992 | Namba | 271/99 |

*Primary Examiner*—H. Grant Skaggs
*Attorney, Agent, or Firm*—Oliff & Berridge

[57] ABSTRACT

A bottom vacuum corrugated feeder (BVCF) includes a tray for supporting a stack of documents. The tray is angled downhill relative to the feeding direction of the documents such that the leading edge of the stack is urged to a common stop member. The tray also includes a single side guide for aligning one side edge of the stack. A stack height sensor sends a signal corresponding to stack height to a controller which in turn controls voltage to be applied to a DC motor controlled blower based on a predetermined ratio of air flow pressure to stack pressure. The structure enables intermixed size document feeding in a BVCF.

24 Claims, 4 Drawing Sheets

DOWNHILL BOTTOM VACUUM CORRUGATED FEEDER AND METHOD

BACKGROUND OF THE INVENTION

The present invention relates to a bottom vacuum corrugated feeder, and more specifically, to a downhill bottom vacuum corrugated feeder which enables feeding of intermixed size documents in a document handler of an image producing device, and a method of feeding a document from a stack of intermixed size documents to a document handler.

With the advent of high speed copy reproduction machines wherein copies can be produced at a rate in excess of three thousand copies per hour, there is a need for a document handler to feed documents to the copy platen of the machine in a rapid, dependable manner to enable full utilization of the reproduction machine's potential copy output. A number of document handlers are currently available to fill that need. These document handlers must operate flawlessly to virtually eliminate the risk of damaging the originals and generate minimum machine shutdowns due to uncorrectable misfeeds or document multifeeds. It is in the initial separation of the individual documents from the document stack where the greatest number of problems occur.

Since the documents must be handled gently but positively to assure separation without damage through a number of cycles, a number of separators have been suggested such as friction rolls or belts used for fairly positive document feeding in conjunction with a retard belt, pad or roll to prevent multifeeds. Vacuum separators such as sniffer tubes, rocker type vacuum rolls or vacuum feed belts have also been utilized.

While the friction roll-retard systems are very positive, the action of the retard member, if it acts upon the printed face, can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

A typical vacuum separating and feeding system is that described in U.S. Pat. No. 4,305,576 entitled "Sheet Separator" to Hamlin, wherein a plurality of friction belts is arranged to run over a vacuum plenum placed at the bottom of a sheet supply tray which has a "U" shaped pocket formed in it. The pocket serves to provide space for the bottom sheet to be captured by the vacuum feed belt assembly, to provide an air seal between the bottom document and the edges of the pocket and to provide a high pressure seal between the bottom sheet and the remainder of the stack. This high pressure seal is achieved by supporting a major portion of the stack weight on the edge regions of the pocket. This seal serves to convert the velocity energy of the air knife flow into a lifting pressure over the pocket area to levitate the remainder of the stack of sheets. This configuration has been used on a commercial scale in the Xerox 5600 machine, and while it has been highly successful in operation, certain aspects can be improved. In particular, the operating window for air knife pressure and stack weight is relatively low which when exceeded causes an unstable pocket to exist. This is manifested by the second sheet vibrating independent of the rest of the stack in a manner referred to as "flutter" and is caused by an aerodynamic instability due to a very low angle of attack of the air knife relative to the stack together with the springness of the sheet. As a result there is a dynamic bouncing of sheet two on sheet one and while it is not coincident with sheet one, sheet two will tend to shingle out of the stack with sheet one resulting in a multifeed. In addition, since the bottommost sheet and sheet two are in the same plane and with sheet two and the remainder of the stack resting on the bottommost sheet, difficulty in separating the bottommost sheet from sheet two can be encountered. This is because there may be some frictional bonding between the bottommost sheet and sheet two.

Further, the operating window of air knife pressure and stack height or weight is low since for additional stack height or weight increments the air knife pressure must be increased thereby increasing the possibility of blowback where the topmost sheet is blown off the stack. Higher air knife pressures are desired since increased amounts of air and increased air pressure increase the reliability of separation of the bottommost sheet from the rest of the stack by providing better levitation of the stack. An additional problem that may be encountered is that of lead edge curl when the lead edge of the sheet being fed may not be captured by the vacuum transport resulting in damage to the sheet and possible misfeed. Furthermore, in addition to the flutter described above, with large stacks the stack of sheets as a whole may flutter or gallop.

In summary, in the bottom sheet feeders difficulties are encountered in both separating the bottommost sheet from the remainder of the stack of sheets and in levitating the remainder of the stack. Moreover, typical vacuum feeders are limited for extended copy jobs in that the feeder assembly can only accommodate a uniform size paper stack. Although the tray can be adjusted to accommodate more than one document size, the apparatuses cannot accommodate for an intermixed size document stack.

Similar problems with regard to separation exist in top sheet vacuum feeders although the necessity to levitate the stack of sheets is not present. In this configuration the air injection means is used to hold the stack of sheets down so that flutter and its attendent multifeed will not occur.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets.

U.S. Pat. No. 2,594,373 (Watson) illustrates a sheet separator with two nozzles wherein each nozzle has two vertically elongated jets which impinge on deflecting surfaces at the mouth of the nozzle to deflect air centrally toward the nozzle mouth which creates a highly turbulent forward moving blast of air. The device is used to separate the rear edge of a stack of sheets as the sheet is advanced forwardly by suckers.

U.S. Pat. No. 3,294,396 (Staines) discloses two sets of air nozzles at the rear of a stack of sheets to be fed, one set to separate the sheets from the stack and the other to float the sheet.

U.S. Pat. No. 3,079,149 (Childs) illustrates the top sheet feeder in which a stream of air rifles a stack of sheets so that the top sheet can be picked up by a vacuum arm. Air rushing into a vacuum duct is used to hold the edges of a sheet down while they are being separated along a different edge.

U.S. Pat. No. 2,402,442 (Perry) describes a sheet separating device containing a baffle which directs two jets of air at the outer edges of a stack of paper. The baffle sets up "whirling" air currents under the top sheet which separates it from the lower lying sheet.

U.S. Pat. No. 3,980,293 (Shelmire) discloses a sheet separating mechanism in which the rear of the top sheet is initially lifted with a vacuum arm followed by air blasts from the rear and front which provide an air cushion between the first and second sheets. The device also incorporates hold-down feed for sheets underlying the topmost sheet.

U.S. Pat. Nos. 4,418,905 (Garavuso) and 4,462,586 (Browne et al.) disclose a vacuum corrugating feeder air knife, and a tray for a recirculating document handler RDH. The operation of the vacuum channel of the present invention is substantially similar to that described in the above-mentioned '905 and '586 patents.

All references cited in this specification, and their references, are incorporated by reference herein where appropriate for appropriate teachings of additional or alternative details, features and/or technical background.

SUMMARY OF THE INVENTION

It is therefore an object of the present invention to provide a bottom vacuum corrugated feeder (BVCF) and method which overcome the above-described problems in the prior art.

It is another object of the present invention to provide a downhill BVCF and method which enable feeding of intermixed size documents while avoiding multifeeds, misfeeds, and sheet damage.

These and other objects of the present invention are achieved by providing a BVCF including a stack supporting tray having only a single side guide member for aligning one side of the documents of the stack. The stack supporting tray is disposed at a predetermined downhill angle with respect to the document feeding direction. The BVCF further includes an apparatus for feeding a sheet from the stack in a feed direction, an air injection device disposed downstream of the stack supporting tray in the feed direction for injecting air between a document to be fed and the remainder of the stack, and a device for aligning the lead edge of the documents of the stack without restraining the rear edge of the documents. The aligning device is disposed between the stack supporting tray and the air injection device.

In accordance with another aspect of the present invention, the device for aligning the lead edge of the documents is at least one fang member disposed above the stack supporting tray. The fang member is preferably of a concave shape to accommodate curled documents. In addition, the fang member is preferably pivotable between a loading position and a use position.

In accordance with another aspect of the prevent invention, the air injection device is at least one air knife jet. Air flow pressure from the at least one air knife jet is controlled by voltage supplied to a DC motor controlled blower. The apparatus further includes a measuring device for measuring the stack height and sending a signal corresponding to stack height to a controller. The controller thereby controls the voltage supplied to the DC motor controlled blower based on the stack height.

In accordance with yet another aspect of the present invention, the measuring device is a set separator.

In accordance with still another aspect of the present invention, the stack pressure is a function of stack height and the controller controls the voltage using a predetermined ratio of air flow pressure to stack pressure.

In accordance with another aspect of the present invention, a method of feeding a document from a stack of intermixed sized documents to a document handler in a feed direction includes the steps of loading the stack of intermixed sized documents into a stack supporting tray, urging the documents in the tray towards at least one restraining member, aligning the lead edges by using the at least one restraining member, restraining the lead edges of the documents without restraining the rear edges of the documents, aligning one of the side edges of the documents with a single side guide without aligning the other of the side edges, injecting air between a document to be fed and the remainder of the stack, and feeding the document to be fed to the document handler.

In accordance with another aspect of the present invention, the at least one restraining member is a fang member. The method further includes, prior to the loading step, the step of resting the fang member on a surface of the stack supporting tray, and, prior to the injecting step, the step of articulating the fang member thereby providing a space between the surface and the fang member.

In accordance with yet another aspect of the present invention, the air flow pressure of the air injected in the injecting step is produced by a DC motor controlled blower. The method further includes the steps of measuring stack height and controlling voltage supplied to the DC motor controlled blower based on the stack height.

In accordance with still another aspect of the present invention, the controlling step controls the voltage using a predetermined ratio of air flow pressure to stack pressure.

In accordance with another aspect of the present invention, the urging step includes the step of declining the stack support tray at a downhill angle with respect to the document feed direction.

BRIEF DESCRIPTION OF THE DRAWINGS

Other objects and advantages will become apparent to those skilled in the art through the following detailed description of preferred embodiments taking in connection with the accompanying drawings, in which.

DETAILED DESCRIPTION OF PREFERRED EMBODIMENTS

Figure 1:
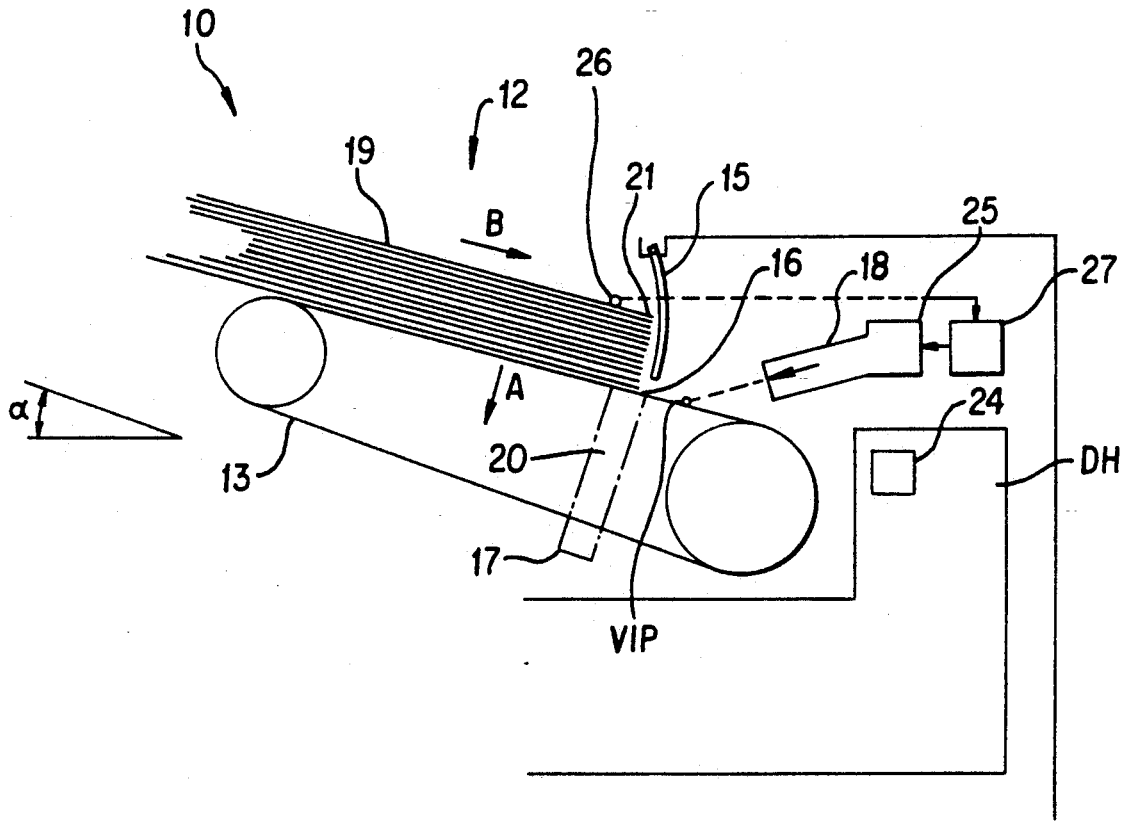
FIG. 1 shows a side view of the elements of the D-BCVF of the present invention.
Figure 2:
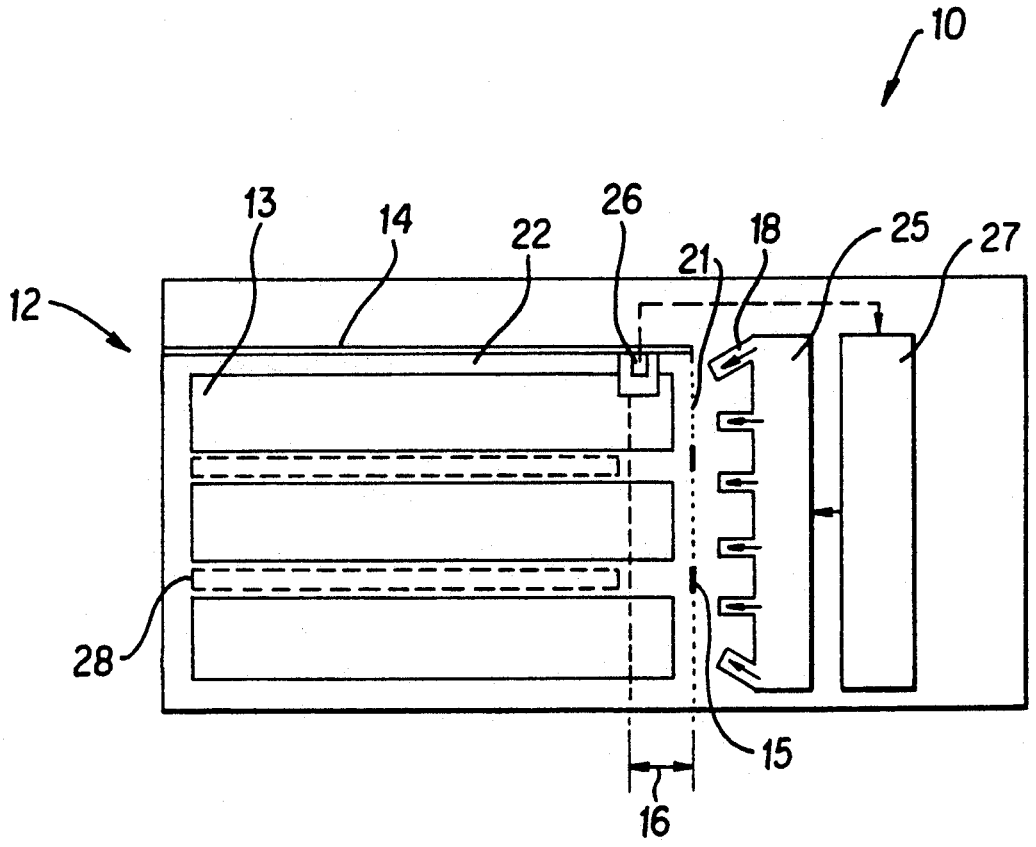
FIG. 2 shows a view from above FIG. 1.

Referring to FIGS. 1 and 2, the present invention is depicted in use with a copy machine for illustrative purposes only. Those skilled in the art will be able to contemplate application to any document handling apparatus.

The downhill bottom vacuum corrugated feeder (D-BVCF) of the present invention includes a feeder assembly 10 and a document handler DH. The invention is applicable to both a recirculating document handler RDH and a semi-automatic document handler SADH. In addition, any type of RDH or SADH may be used. One such document handler is disclosed in U.S. Pat. No. 4,176,945, assigned to Xerox Corporation, the disclosure of which is hereby incorporated by reference.

The feeder assembly 10 includes a tray 12 for holding a stack of intermixed size documents 19 to be copied, a conveyor 13 including a vacuum opening 16 to expose the document being copied to a vacuum channel 20 that is opened and closed by a feedhead valve 17, and a side guide 14 for aligning a side edge 22 of the intermixed size document stack 19. The assembly also includes two fangs 15 which are pivotally attached to the copy machine above conveyor 13. The fangs 15 align the leading edge of the stack of documents 19. To enable intermixed size document feeding in a BVCF, it is necessary for all of documents 19 to have a common lead edge 21. This is accomplished by arranging tray 12 at a downhill angle $\alpha$. The downhill angle $\alpha$ is in the range of 2°-30° and is preferably about 15°. This angle causes the stack of documents 19 to be urged against fangs 15. Thus, the stack of intermixed sized documents 19 has two common edges, the lead edge 21 via fangs 15 and a side edge 22 via side guide 14. In the case of an RDH, the downhill angle $\alpha$ facilitates restack by assisting the documents 19 in returning to their original position.

In the prior art, an additional side guide and a rear guide are also included with the tray to stabilize the stack during feeding. To accommodate intermixed size documents however, the rear guide and second side guide are omitted.

Document handler DH preferably includes six air knife jets 18. The operation and function of the air knife jets 18 are the same as with the prior art BCVF. A positive air stream ejected from the air knife 18 supports the component of weight of the stack in the direction normal to tray 12 (arrow A in FIG. 1). The air knife jets 18 lift all but the bottom sheet of the stack of documents above the fangs. To reduce manufacturing costs, the air flow to the air knife jets 18 is supplied via a simple DC motor controlled blower 25. In addition, the air knife jets 18 are left on continuously to prevent the stack from falling below fangs 15. As a result, costs are further reduced in view of the elimination of the need for a control valve, solenoid, electrical harness and software as required in the prior art air knife arrangements.

Venting of the air flow from air knife jets 18 is required to achieve levitation. In the present invention, tray 12 includes rails 28 (shown in phantom in FIG. 2) placed directly behind vacuum channel 16 and parallel to the feed direction. When the air knife levitates the stack, the air leaving the stack can cause a wave-like motion resulting in instability. Rails 28 prevent such wave-like motion thereby extending the operating window. When the sheet is acquired, the part of the sheet in the area formed around rails 28 provides a channel for the air to escape.

The pressure of the flow of the air knife jets is an important parameter for feeding of intermixed sized documents. In the prior art feeder, the air flow pressure could be substantially large to accommodate a large maximum document stack. For example, assuming a fifty document maximum in the feeder, the air flow pressure from the air knife jets could be constant at a sufficient pressure to support fifty documents. Because of the existence of the rear guide and both side guides, a smaller stack (for example, two documents) would remain stable and be properly fed even though the air flow pressure is substantially greater than that required for the smaller stack. In the present invention, to enable intermixed size document feeding, the additional side guide and rear guide are eliminated. Thus, if the air flow pressure is substantially greater than the stack pressure, blowback may occur. Blowback is when the air knife jets actually cause the documents in the tray to blow out of position or even completely out of the tray. When a blownback sheet is acquired, the lead edge of the sheet above it also gets acquired, and the two sheets are fed simultaneously. In addition, before blowback, an excessive air flow pressure will cause the stack to become unstable, resulting in multifeeds and misfeeds.

Figure 3:
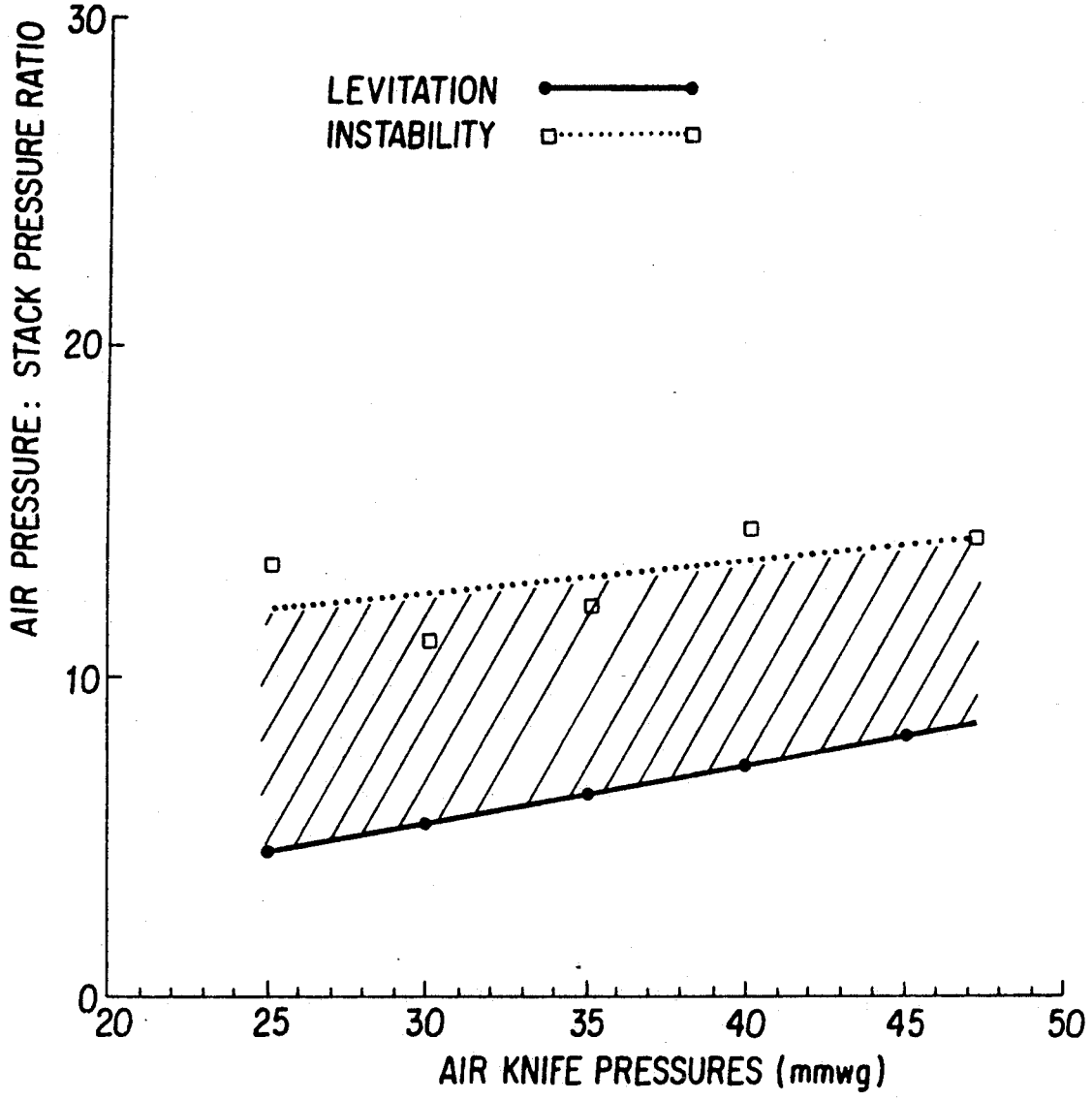
FIG. 3 depicts a graph showing the operating window for the air flow pressure.

To overcome this problem, the present invention includes a set separator 26 which gauges stack height and sends a signal to a control unit 27. Control unit 27 controls the amount of voltage supplied to the DC motor to achieve the proper air flow pressure setting. The ratio of air flow pressure to stack pressure remains constant. Stack pressure is a function of stack height. Although the weight of the stack may vary between identical stack heights, the air flow pressure is set at a value which enables leviation of the heaviest contemplated stack (i.e., all documents being the largest size that can be accommodated by the particular image producing device) while preventing the stack of the lightest contemplated stack (i.e., all documents being the smallest size that can be accommodated by the particular image producing device) from becoming unstable. FIG. 3 is a graph showing the operating window (crosshatched area) of the air flow from air knife jets 18. The operating window is defined by the area between levitation and instability. The levitation line can be represented by the formula:

$$y=0.1784x+0.0092 \quad (1).$$

The ratio of air flow pressure to stack pressure is in the range of 1-15 and preferably about 3-5. This ratio range has been found to successfully levitate a wide variety of stacks without causing instability.

The stack height generally stays constant when the feeder is used in conjunction with a recirculating document handler RDH. Hence, set separator 26 need only take a single reading to send a signal corresponding to height measurement to controller 27. With other document handlers, set separator 26 may be constantly in communication with controller 27, and controller 27 may be constantly varying the air flow pressure accordingly. However, as described above, the air flow pressure to stack pressure ratio preferably remains constant.

Alternatively, a switch may be provided on a control panel of the copy machine which enables an operator to manually select a light mode, regular mode or heavy mode. In each instance, a signal would be provided to controller 27 and the pressure ratio would be adjusted accordingly. The operator would be instructed to select the light mode only when there is an abundance of very small documents in the stack, and conversely, the user would be instructed to select the heavy mode only when there is an abundance of very large documents in the stack. All other times, the regular mode would be selected.

The virtual impingement point (VIP) of the air flow from air knife jets 18 is an important parameter to achieve consistent successful levitation. The VIP is the point in front of the tray where the air flow is reflected into the stack. The air from the air knife jets is "bounced" into the stack at a predetermined angle. The air causes the pocket to form enabling proper feeding of the documents. The VIP should be optimized to achieve the largest operating window. In the present invention, the VIP is preferably about 6 mm downstream of lead edge 21.

As described above, fangs 15 are pivotally attached to document handler DH above conveyor 13. Fangs 15 are preferably wire form to allow positive air from air knife jets 18 to pass through fangs 15, allowing for greater pocket stability. Other forms may certainly be contemplated, and the invention is not meant to be limited to wire fangs. The fangs support the component of the weight of the stack in the drive direction of the documents (arrow B in FIG. 1). During loading, the fangs are recessed below the tray surface. At this time, the fangs support the leading edge of documents 19 and provide a common lead edge 21 for feeding. Once air knife jets 18 have lifted the stack, fangs 15 are articulted upward, leaving a gap between the bottom of the fangs and tray 12. Preferably, the gap is about 2 mm. When fangs 15 are articulated upward, they are preferably perpendicular to the conveyor.

To overcome problems caused by the feeding of curled documents, fangs 15 preferably have a concave shape. The concave shape allows the curled sheets to ride down the fangs during acquisition. Other shapes may certainly be contemplated, and the invention is not meant to be limited a concave shape.

Figure 4:
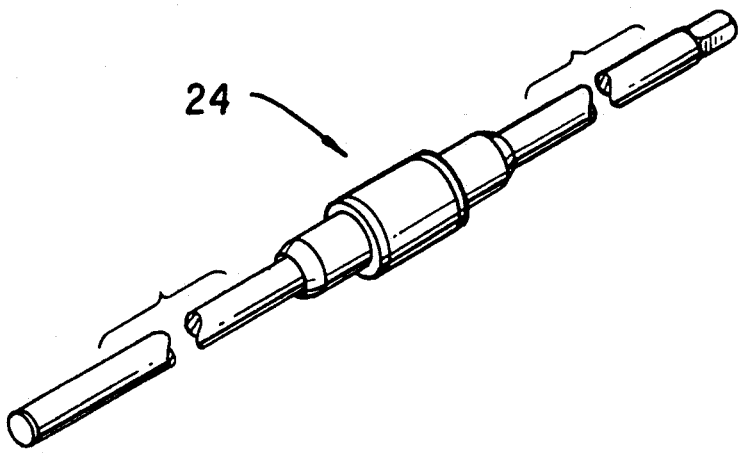
FIG. 4 shows an example of a slip clutch to be used in the present invention.

Referring to FIGS. 1 and 4, a slip clutch 24, preferably of the dual diameter wrap spring type, is disposed in document handler DH in the idler of the take away roll to act as a brake. In the event of a multifeed (i.e., more than one document is fed from the stack), clutch 24 is subjected to a torque in the drive direction due to the coefficient of friction between two pieces of paper. This torque is insufficient to overcome the slip clutch torque. The idler remains stationary acting as a retard member holding the top sheet back. With only a single sheet in the nip, the torque transmitted to the clutch through the sheet is much higher. As a result, it is able to unwrap the spring from the shaft race allowing the idler to turn in the drive direction. In the event of a jam, a reverse drive direction torque wraps the spring tight thereby loosening its grip on the idler race and allowing the idler to rotate in the reverse direction for jam clearance. The occurrence of multifeed necessitates timing changes in feedhead valve 17 with respect to point in time and duration. Hence, slip clutch 24 may be connected to controller 27 to control the operation of feedhead valve 17. Such a nip clutch contemplated for the present invention is the Galahad particular slip clutch contemplated for the present invention is the Galahad Slip Clutch (5046) XPN 6E12160-03 manufactured by Dynacorp, Inc. Other types of slip clutches may be used, and the invention is not meant to be limited to the above-mentioned slip clutch.

Although the invention has been described in detail, those skilled in the art will contemplate numerous variations that are within the scope of the invention, which is outlined in the following claims.

What is claimed is:

1. A document feeding apparatus for feeding documents from a stack of documents, comprising:

means for feeding a document from said said stack of documents in a feed direction, the documents each having two side edges parallel to the feed direction and lead and rear edges perpendicular to the feed direction;

a stack supporting tray located above the feeding means and having only a single side guide member for aligning one of said side edges of said documents of said stack, said stack supporting tray being disposed at a predetermined downhill angle with respect to the document feed direction;

air injection means disposed downstream of said stack supporting tray in the feed direction for injecting air between a document to be fed and the remainder of said stack; and means for aligning the read edge of said documents of said stack without restraining the rear edge, said means for aligning disposed between said stack supporting tray and said air injection means.

2. The document feeding apparatus according to claim 1, wherein said means for aligning the lead edges of said documents of said stack is at least one fang member disposed above said stack supporting tray.

3. The document feeding apparatus according to claim 2, wherein said at least one fang member has a concave shape in the feed direction relative to said stack of documents.

4. The document feeding apparatus according to claim 2, wherein said at least one fang member is pivotable between a loading position and a use position, said at least one fang member resting on a surface of said stack supporting tray in said loading position, and said at least one fang member being articulated in said use position to provide a gap between said surface and said at least one fang member.

5. The document feeding apparatus according to claim 4, wherein said gap is about 2 mm.

6. The document feeding apparatus according to claim 1, wherein said air injection means is at least one air knife jet, air flow pressure from said at least one air knife jet being controlled by voltage supplied to a DC motor controlled blower, the sheet feeding apparatus further comprising means for measuring stack height wherein said means for measuring stack height sends a signal corresponding to stack height to a controller, said controller controlling said voltage supplied to said DC motor controlled blower based on said signal from said means for measuring stack height.

7. The document feeding apparatus of claim 6, wherein said means for measuring stack height is a set separator.

8. The document feeding apparatus of claim 6, wherein stack pressure is a function of said stack height and said controller controls said voltage using a predetermined ratio of said air flow pressure to said stack pressure.

9. The document feeding apparatus of claim 8, wherein said ratio is constant.

10. The document feeding apparatus of claim 9, wherein said ratio is in the range of 1-15.

11. The document feeding apparatus of claim 10, wherein said ratio is in the range of 3-5.

12. The document feeding apparatus of claim 1, wherein said documents of said stack are of intermixed sizes.

13. The document feeding apparatus of claim 1, wherein said predetermined angle is in the range of 2°-30°.

14. The document feeding apparatus of claim 13, wherein said predetermined angle is about 15°.

15. A method of feeding a document from a stack of intermixed size documents to a document handler in a feed direction, said documents each having two side edges parallel to the feed direction and lead and rear edges perpendicular to the feed direction, the method comprising the steps of:

loading said stack of intermixed size documents into a stack supporting tray;

urging said documents in said tray towards at least one restraining member;

aligning said lead edges by using said at least one restraining member;

restraining said lead edges of said documents without restraining said rear edges of said documents;

aligning one of said side edges with a single side guide without aligning the other of said side edges;

injecting air between a document to be fed and the remainder of said stack; and feeding said document to be fed to said document handler.

16. The method of claim 15, wherein said at least one restraining member is a fang member, the method further comprising, prior to said loading step, the step of resting said fang member on a surface of said stack supporting tray, and, prior to said injecting step, the step of articulating said fang member thereby providing a space between said surface and said fang member.

17. The method of claim 15, wherein air flow pressure of said air injected in said injecting step is produced by a DC motor controlled blower, the method further comprising the steps of measuring stack height and controlling voltage supplied to said DC motor controlled blower based on said stack height.

18. The method of claim 17, wherein stack pressure is a function of stack height, said controlling step controlling said voltage using a predetermined ratio of said air flow pressure to said stack pressure.

19. The method of claim 18, wherein said ratio is constant.

20. The method of claim 19, wherein said ratio is in the range of 1-15.

21. The method of claim 20, wherein said ratio is in the range of 3-5.

22. The method of claim 15, wherein said urging step includes the step of declining said stack support tray at a downhill angle with respect to the document feed direction.

23. The method of claim 15, wherein said predetermined angle is in the range of 2°-30°.

24. The method of claim 23, wherein said predetermined angle is about 15°.

* * * * *